United States Patent [19]

Dennis, Jr.

[11] 4,427,140

[45] Jan. 24, 1984

[54] WINDOW WASHING KIT

[76] Inventor: Charles H. Dennis, Jr., 616 E. 8th St., Muncie, Ind. 47302

[21] Appl. No.: 209,067

[22] Filed: Nov. 21, 1980

[51] Int. Cl.[3] ..... A45C 1/04; B65D 35/28

[52] U.S. Cl. ..... 224/148; 222/175; 15/1

[58] Field of Search ..... 224/148; 222/175, 206, 222/214, 530; 15/244 R, 1

[56] References Cited

U.S. PATENT DOCUMENTS

| | | | |
|---|---|---|---|
| 1,959,782 | 5/1934 | Fenwick, Jr. | 224/148 X |
| 2,095,351 | 10/1937 | Van Winkle | 224/148 X |
| 2,793,073 | 5/1957 | Bateman | 222/175 |
| 2,915,222 | 12/1959 | Purinton | 222/175 |
| 3,960,294 | 6/1976 | Bernard | 222/175 X |
| 4,139,130 | 2/1979 | Glusker et al. | 224/148 |
| 4,176,772 | 12/1979 | Danon | 224/148 |

*Primary Examiner*—Steven M. Pollard
*Attorney, Agent, or Firm*—Dennis H. Lambert

[57] ABSTRACT

A window washing kit in which a belt to be worn by the window washer is hollow for containing water to be used in washing windows, and has tubes attached thereto for wetting a scrubber used in washing windows. The belt also has holders for holding scrubbers and squeegees when they are not being used by the window washer. The scrubber or water applicators are unique and comprise a metal frame with a layer of foam for retaining water and a layer of cloth or the like for scrubbing windows. Further, the kit includes a pole for holding a scrubber or squeegee during use, and is configured to permit easy swivelling of the scrubber or squeegee during use. The pole also has bifurcated ends for holding a blade or the like for scraping windows.

8 Claims, 6 Drawing Figures

WINDOW WASHING KIT

BACKGROUND OF THE INVENTION

The invention relates to window washing apparatus and more particularly, to a window washing kit primarily intended for use by professional window washers.

Large office buildings, apartment houses and the like are maintained by professional staffs and professional window washers are hired to periodically clean the windows of such buildings. Apparatus typically used comprises a sponge or stripper for applying water and/or soap to the window, a squeegee for drying the window and one or more buckets for containing water used in washing the windows. Moreover, the buildings which are generally serviced by professional window washers usually are multi-story and the window washers are working at elevations considerably above the ground. The apparatus typically used in the prior art for washing windows presents a danger to persons walking on the ground beneath the window washers since the buckets and the like used by the window washers are susceptible of being accidentally kicked or otherwise knocked off of scaffolds and the like used for washing windows at the upper stories.

SUMMARY OF THE INVENTION

It is therefore a principal object of the present invention to provide a kit for window washers which eliminates the dangers described above and in which everything is self-contained which is generally required by the window washer.

A more specific object of the invention is to provide an economical kit including a belt which is worn by the window washer and which is hollow for containing water used in washing windows, thus eliminating separate buckets and the like.

Yet another object of the invention is to provide a stripper or scrubber for applying water to windows in which a rigid frame has a layer of foam thereon for retaining water and a layer of towel or like material over the foam for scrubbing windows.

A still further object of the invention is to provide a unique pole for use in operating the stripper or scrubber and/or a squeegee during washing of windows in which the pole is specially configured to permit easy swivelling of the squeegee and stripper during use, and further, wherein the pole has structure at its opposite ends for holding a blade to be used in scraping tape, paint and the like from windows being cleaned.

The belt for containing water also has devices attached thereto for carrying a stripper and squeegee when they are not in use. The belt may be made from any suitable material such as rubber, leather, vinyl or the like, and has hollow tubes attached thereto with an open end normally secured adjacent the belt but which may be lowered for wetting the stripper or water applicator when desired.

DETAILED DESCRIPTION OF THE PREFERRED EMBODIMENT

Figure 1:
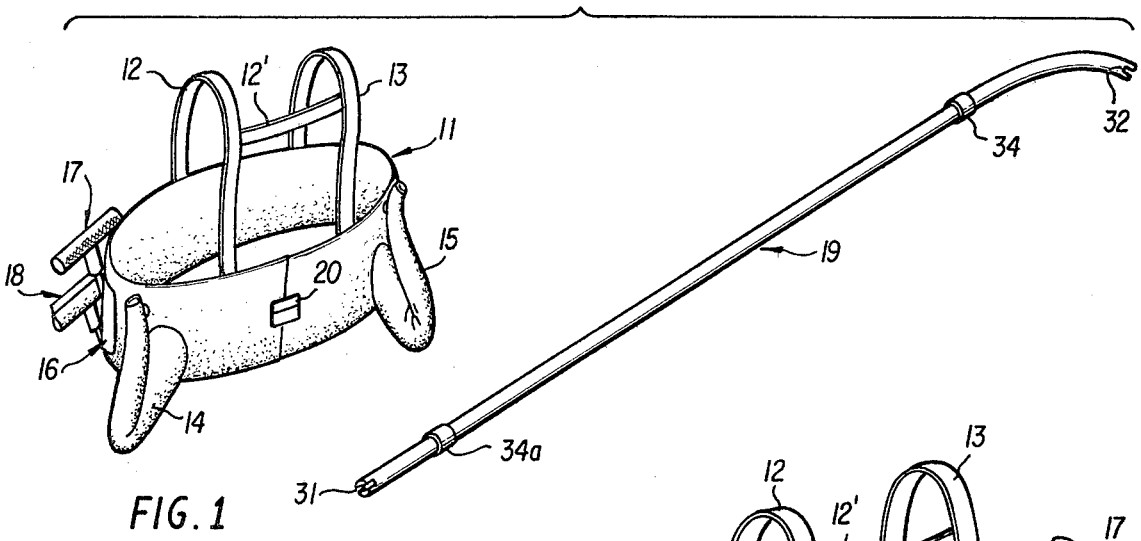
FIG. 1 is a perspective view of the belt used with the kit of the invention.

In the drawings, wherein like reference numerals indicate like parts throughout the several views, the kit is indicated generally at 10 in FIG. 1, and comprises the belt 11 with suspenders 12 and 13, tubes 14 and 15, support 16, stripper 17, squeegee 18 and pole 19.

Figure 2:
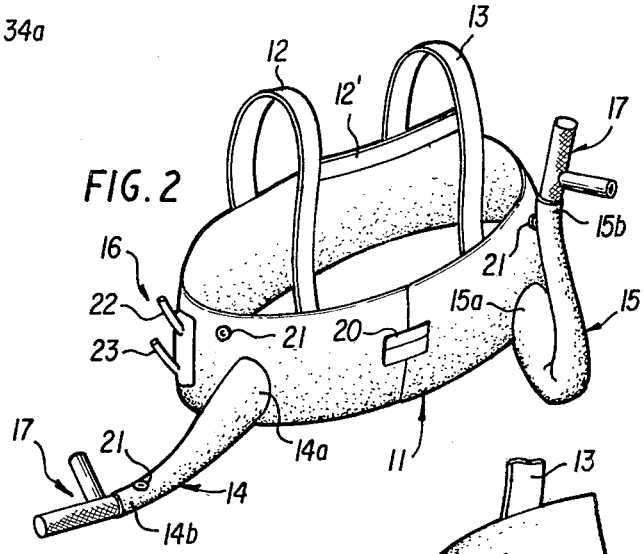
FIG. 2 is a view in side elevation of the belt of FIG. 1.
Figure 3:
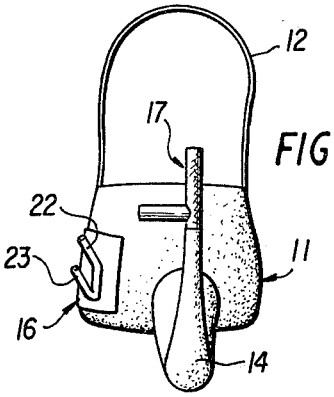
FIG. 3 is an enlarged fragmentary perspective view of a portion of the belt of FIG. 2, showing a scrubber and squeegee attached thereto.
Figure 4:
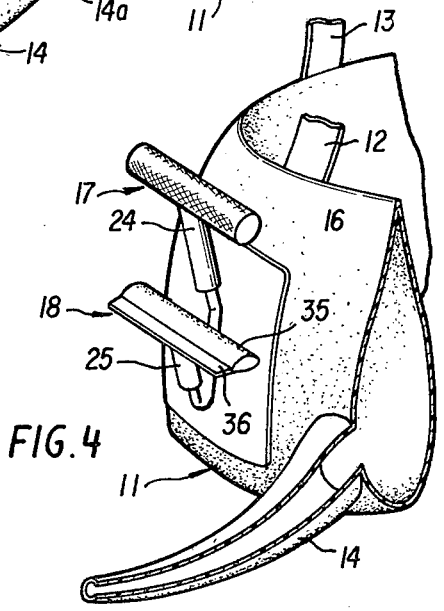
FIG. 4 is a perspective view with portions broken away of the scrubber or applicator used in the kit of the invention.

Referring more particularly to FIGS. 2, 3 and 4, the belt 11 is of tubular construction and has a buckle 20 for buckling the belt about the body of the user. The suspenders or straps 12 and 13 then pass upwardly over the shoulders of the user to support the weight of the water-filled belt. The belt may be of any suitable material such as plastic, rubber, leather and the like, and the tubes 14 and 15 may taper from a large end **14*a* and 15*a*, respectively, attached to the belt, to a smaller end 14*b* and 15*b*, respectively, remote or distal from the belt. Suitable fastening means such as snap fasteners or the like 21 are provided on the tubes 14 and 15 and on the belt for securing the open distal ends 14*b* and 15*b* of the tubes in an upward position adjacent the belt as seen in FIGS. 2 and 3. Also, a cross tie 12' may extend between the straps 12 and 13**, if desired, to keep them on the shoulders of the user.

The support 16 is affixed to the belt at a rear portion thereof and includes a bracket or pair of prongs 22 and 23 thereon extending in a generally upward direction for receiving the hollow ends 24 and 25 of the scrubber 17 and squeegee 18, respectively, as seen best in FIG. 4. The support 16 may be made as a separate item, if desired, with a stiff base or backing which may be inserted into the pocket of the window washer if the support 16 is desired for use to carry a scrubber and squeege,but the complete belt is not desired.

Figure 5:
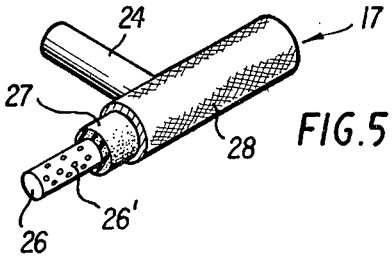
FIG. 5 is an exploded perspective view showing the pole used with the kit of the invention and having a blade associated with one end thereof, and a scrubber or applicator associated with the other end.

In FIG. 5, the scrubber or water applicator 17 is seen as comprising a rigid frame 26 of metal, plastic or other suitable material and a layer of foam 27 covers the frame 26. A layer of cloth or other material such as towel or the like 28, is placed over the layer of foam for providing scrubbing action when washing windows. As seen in this figure, the scrubber 17 is generally T-shaped in configuration and has a hollow shaft 24 projecting at right angles from the foam covered portion thereof. The foam covered portion 26 has closed ends and a plurality of holes 26' therethrough. As explained previously, the shaft 24 may be inserted downwardly over the upwardly extending prong 22 of support 16 when the stripper is not in use.

Figure 6:
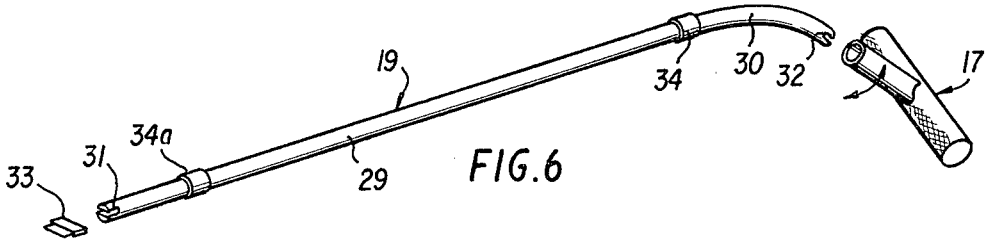
FIG. 6 is a perspective view of one of the tools used in the kit of the invention.

In FIG. 6, the pole 19 comprises an elongate, one-piece member 29 of wood, metal, plastic or other suitable material having a curved end 30 at one end and the remainder of the pole being straight. Rather than one-piece, the pole can be made in multiple pieces whereby it can be "knocked down" for transportation, storage, etc. Both ends of the pole are bifurcated or slit, as indicated at 31 and 32, for receiving a blade or the like 33 for use in scraping paint, tape and the like from windows. Collars 34 and **34*a* are secured around the pole adjacent opposite ends thereof for preventing water from running down the pole when the pole is being used with a scrubber or squeegee as indicated at 17. The hollow shaft 24 of the scrubber (or 25 of squeegee 18) may be inserted over either end of the pole 19. When either the scrubber or squeegee is placed on the curved end 30**, a natural swivelling action is obtained which greatly facilitates use of the scrubber or squeegee in washing windows. In other words, with conventional devices the window washer needs to impart considerable flexing motion to his arms and wrists in order to effect proper swivelling motion of the squeegee or scrubber to obtain maximum efficiency in washing windows.

The squeegee 18 may be of conventional construction and include a metal shaft 25 with a metal back or frame 35 having a rubber or other flexible edge 36 secured thereto.

In use, the belt is positioned upon the body of the user and a hose or faucet or the like associated with one of the open ends **14*b* or 15*b* of one of the tubes, and water is caused to flow into the belt filling the belt and tubes. Scrubbers 17 may have one of their ends inserted into the open ends of the tubes 14 and 15 as indicated in FIG. 2, and the tubes secured in their upper positions as shown at the right of FIG. 2 and in FIG. 3. When it is desired to wet one of the scrubbers for use, the tube is released from its fastener 21 and held in a downwardly inclined position as shown at the left of FIG. 2 and water will flow from the belt down the tube and into the foam or sponge or the like 27 of the scrubber. When the foam or sponge or the like is appropriately saturated, the tube is again moved to its upper position and secured with the fastener 21** and the scrubber then removed from the tube. When the scrubber is used in washing a window, water quickly becomes distributed throughout the foam material, whereby the entire area or length of the scrubber may be utilized in washing a window.

As this invention may be embodied in several forms without departing from the spirit or essential characteristics thereof, the present embodiment is, therefore, illustrative and not restrictive, since the scope of the invention is defined by the appended claims rather than by the description preceeding them, and all changes that fall within the metes and bounds of the claims or that form their functional as well as conjointly cooperative equivalents are, therefore, intended to embraced by those claims.

What is claimed is:

1. A window washing kit comprising:

a tubular belt to be worn about the body of the user and having a hollow interior for containing water to be used for washing windows;

at least one tube joined at one end to the belt and being in fluid communication with the hollow interior of the belt for receiving water therefrom, the other end of the tube being open;

a scrubber or water applicator having one end thereof received in the open end of the tube and supported thereby; and an elongate pole for supporting the scrubber at either end of the pole when the scrubber is being used to wash windows.

2. A kit as in claim 1, wherein:

a support is fixed to the belt and has projections thereon for supporting and storing a scrubber and squeegee; and a squeegee supported on one of the projections.

3. A kit as in claim 2, wherein:

the belt and tube have fastening means thereon for attaching the tube open end to the belt to support the open end in an upper position to prevent loss of water therefrom.

4. A kit as in claim 3, wherein:

there are two tubes connected to the belt, one on either side thereof.

5. A kit as in claim 4, wherein:

a pair of straps or suspenders are fixed to the belt for placement over the shoulders of the user to assist in supporting the weight of the belt during use.

6. A kit as in claim 1, wherein:

the scrubber comprises a rigid hollow frame having generally a T-shaped configuration, the shaft of the T having an open end for introducing water into the hollow T frame, and the cross of the T having a plurality of openings therethrough for flow of water therefrom;

a layer of foam over the frame for retaining a quantity of water; and a layer of cloth over the foam for scrubbing a window.

7. A kit as in claim 1, wherein:

the pole has a curved end, whereby swivelling of the scrubber is facilitated during use; and at least one end of the pole is bifurcated for holding a blade for use in scrapping paint, tape and the like from windows.

8. A kit as in claim 7, wherein:

the scrubber has a tubular attaching shaft, and the shaft is receivable over either end of the pole, said scrubber being pivotable about the axis of the shaft and pole.

* * * * *